US008256770B1

(12) United States Patent
Mousa et al.

(10) Patent No.: US 8,256,770 B1
(45) Date of Patent: Sep. 4, 2012

(54) SKILL GAME APPARATUSES

(75) Inventors: Osama Ibrahim Mohamad Mousa, Long Beach, CA (US); Joselito Santiago DeGuzman, Torrance, CA (US)

(73) Assignee: Treasure Box, Inc., Signal Hill, CA (US)

( * ) Notice: Subject to any disclaimer, the term of this patent is extended or adjusted under 35 U.S.C. 154(b) by 0 days.

(21) Appl. No.: 13/079,797

(22) Filed: Apr. 4, 2011

(51) Int. Cl.
*A63F 7/02* (2006.01)

(52) U.S. Cl. ..... 273/138.3; 273/138.2; 273/138.1; 273/454; 273/460; 273/459

(58) Field of Classification Search ..... 273/449, 273/450, 445–447, 441, 138.1, 138.2, 138.3, 273/459, 460
See application file for complete search history.

(56) References Cited

U.S. PATENT DOCUMENTS

| | | | | |
|---|---|---|---|---|
| 2,593,641 | A | 4/1952 | Wolverton | |
| 4,215,863 | A | 8/1980 | Kuiper | |
| 4,272,082 | A | 6/1981 | Shoemaker, Jr. | |
| 4,662,636 | A | 5/1987 | Crompton | |
| 4,744,566 | A | 5/1988 | Malavazos et al. | |
| 4,770,415 | A | 9/1988 | Evans et al. | |
| 5,011,147 | A | 4/1991 | Thomas et al. | |
| 5,071,127 | A | 12/1991 | Bromley et al. | |
| 5,275,402 | A | 1/1994 | Malavazos et al. | |
| 5,301,942 | A | 4/1994 | Lacrosse | |
| 5,326,108 | A | 7/1994 | Faith | |
| 5,445,138 | A | 8/1995 | Faith | |
| 5,445,376 | A | 8/1995 | Bromley | |
| 5,501,466 | A | 3/1996 | Welch et al. | |
| 5,507,490 | A * | 4/1996 | Hagiwara | 463/16 |
| 5,713,572 | A | 2/1998 | Hagiwara | |
| 6,264,197 | B1 * | 7/2001 | Halliburton | 273/138.2 |
| 6,550,768 | B2 | 4/2003 | Jordan | |
| 6,899,328 | B2 | 5/2005 | Halliburton et al. | |

(Continued)

FOREIGN PATENT DOCUMENTS

GB 2320443 A 6/1998

OTHER PUBLICATIONS

Redemption Machines: 1991 'Bank-It' 1-player coin toss redemption game. Amusement Trader.com, 2010 [previously retrieved on Sep. 14, 2010]. Retrieved from the internet: <URL: http://www.amusementtrader.com/201/Redemption-Machines/listings/3382/1991-Bank-It-1-player-coin-toss-redemption-game.html>.

(Continued)

*Primary Examiner* — Raleigh W. Chiu
(74) *Attorney, Agent, or Firm* — Henricks, Slavin & Holmes LLP

(57) ABSTRACT

Skill game apparatuses include one or more game piece guiding elements configured to influence movement of game pieces within a game piece path in a manner that is dependent at least in part upon the skill of the player. In one embodiment, the back portion of a skill game apparatus is provided with one or more guide channels configured to limit horizontal movement by a game piece as it moves from the top of the back portion to a base portion of the skill game apparatus. In another embodiment, the skill game apparatus includes one or more player-repositionable guide members along a game piece path that are moveable in response to inputs provided by one or more player-operated controller devices.

40 Claims, 6 Drawing Sheets

Game piece guide channels

U.S. PATENT DOCUMENTS

| | | | | |
|---|---|---|---|---|
| 6,991,230 | B1 | 1/2006 | Shoemaker | |
| 7,168,702 | B1 | 1/2007 | Shoemaker | |
| 7,896,345 | B2 * | 3/2011 | Cacas | 273/138.1 |
| 7,934,723 | B2 * | 5/2011 | Sasaki et al. | 273/138.3 |
| 2003/0020234 | A1 * | 1/2003 | Jordan | 273/138.3 |
| 2003/0073479 | A1 * | 4/2003 | Wilson et al. | 463/16 |
| 2004/0036224 | A1 * | 2/2004 | Crompton | 273/454 |
| 2007/0018407 | A1 * | 1/2007 | Shoemaker | 273/356 |
| 2007/0126185 | A1 * | 6/2007 | Fukuzawa et al. | 273/447 |
| 2007/0200289 | A1 * | 8/2007 | Morikawa et al. | 273/120 A |
| 2007/0296146 | A1 * | 12/2007 | Omoto et al. | 273/138.3 |
| 2009/0033032 | A1 * | 2/2009 | Niwa et al. | 273/138.3 |
| 2009/0174146 | A1 | 7/2009 | Wichinsky | |
| 2010/0096803 | A1 * | 4/2010 | Sasaki et al. | 273/138.3 |

OTHER PUBLICATIONS

Price Is Right 6 Player. Birmingham Vending Company, Inc., 2010 [previously retrieved on Sep. 14, 2010]. Retrieved from the internet: <URL: http://www.bhmvending.com/Amusements/ICE/ice_price_is_right_6player.html>.

* cited by examiner

Game piece guide channels

Retractable guide members and actuation indicators

Joystick controller

Retractable guide pins

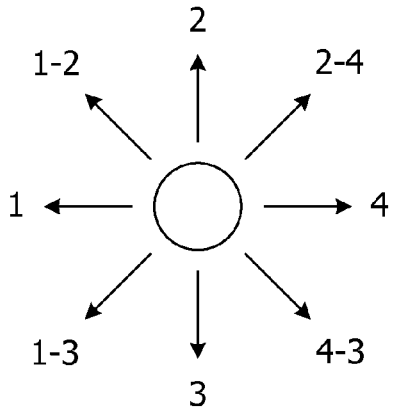
Groups 1-4 actuation control
*FIG. 8*
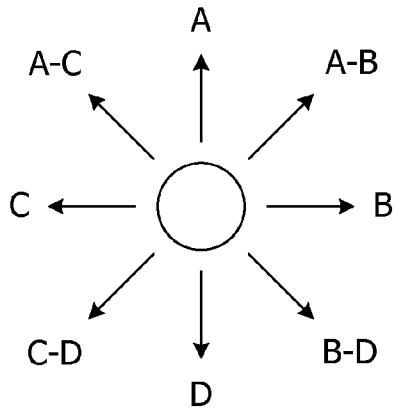
Groups A-D actuation control
*FIG. 9*
182
| 1 | 2 | 3 | 4 | 5 | 6 | 7 | 8 | 9 |
|---|---|---|---|---|---|---|---|---|
| 10 | 11 | 12 | 13 | 14 | 15 | 16 | 17 | 18 |
| 19 | 20 | 21 | 22 | 23 | 24 | 25 | 26 | 27 |
| 28 | 29 | 30 | 31 | 32 | 33 | 34 | 35 | 36 |
| 37 | 38 | 39 | 40 | 41 | 42 | 43 | 44 | 45 |
| 46 | 47 | 48 | 49 | 50 | 51 | 52 | 53 | 54 |
Touch pad – individual guide pin control
*FIG. 10*

Rotatable guide members

Discs 1 and 2 rotation control

SKILL GAME APPARATUSES

TECHNICAL FIELD

The present invention relates generally to skill games and, in particular, skill game apparatuses (e.g., coin pusher game apparatuses) that include one or more game piece guiding elements configured to influence movement of game pieces within a game piece path in a manner that is dependent at least in part upon the skill of the player.

BACKGROUND ART

Various amusement devices are known which include, for example, a base surface over which an automated reciprocating element or the like is configured to sweep and a coin chute which is manually articulable by the player to permit the player to attempt deposition of a coin at a desired point upon the surface. As the course of play progresses and coins are accumulated upon an unswept area of the surface, movement of the reciprocating element eventually results in coins being pushed over an edge of the unswept area and into a trough. In U.S. Pat. No. 4,272,082 (Shoemaker, Jr.), which is hereby incorporated by reference, such a device further includes a multiplicity of surface interruptions secured upon the unswept area of the base surface.

In U.S. Pat. No. 6,550,768 (Jordan), which is hereby incorporated by reference, a coin catching amusement device is provided with one or more player-controlled kickers beneath the edge of a second catcher plate that potentially allow the player to direct coins falling over the edge to a player's hopper. Jordan discloses a coin catching amusement device in which skill is involved in not only directing a coin through the use of the coin guide to a particular area of the pusher field to increase the likelihood of coins falling off the edge, but also in determining where coins are most likely to fall off the edge. By anticipating where coins are likely to fall off the edge, the player can then correctly deploy the appropriate kicker to catch coins falling off the edge.

It would be useful to be able to provide skill game apparatuses in which the skill of the player is tested in additional and/or different ways. It would also be useful to be able to provide skill game apparatuses in which player skill is tested in additional and/or different ways throughout the course of the game. It would also be useful to be able to provide game apparatuses in which skill-based player inputs influence the movement of game pieces in different ways and/or at different times than with conventional amusement devices. It would also be useful to be able to provide game apparatuses embodying one or more of the foregoing which are predominantly games of skill, rather than luck or chance.

SUMMARY OF THE INVENTION

Skill game apparatuses described herein, in example embodiments, include one or more game piece guiding elements configured to influence movement of game pieces within a game piece path in a manner that is dependent at least in part upon the skill of the player.

In an example embodiment, a skill game apparatus includes an enclosure with a front portion through which a player can see inside the enclosure, and a back portion and a base portion that provide a game piece path within the enclosure. The skill game apparatus further includes a game piece introducing device configured to allow a player to direct a game piece toward the back portion, and a pusher device configured to move over the base portion such that the pusher device contacts game pieces that have landed on the base portion. The back portion includes one or more guide channels configured to limit horizontal movement by a game piece as it moves from the top of the back portion to the base portion. The base portion includes a front edge from which a game piece, upon being advanced sufficiently far along the game piece path, drops into a game piece receptacle.

In another example embodiment, a skill game apparatus includes an enclosure with a front portion through which a player can see inside the enclosure, and a back portion and a base portion that provide a game piece path within the enclosure. The skill game apparatus further includes a game piece introducing device configured to allow a player to direct a game piece toward the back portion, a pusher device configured to move over the base portion such that the pusher device contacts game pieces that have landed on the base portion, and one or more player-repositionable game piece guide members that are moveable in relation to the game piece path in response to inputs provided by one or more player controller devices. The base portion includes a front edge from which a game piece, upon being advanced sufficiently far along the game piece path, drops into a game piece receptacle.

BRIEF DESCRIPTION OF THE DRAWINGS

FIG. 8 illustrates an example scheme by which a joystick controller provides user inputs to control groups of the retractable guide pins of FIG. 7;

FIG. 9 illustrates another example scheme by which a joystick controller provides user inputs to control groups of the retractable guide pins of FIG. 7;

FIG. 10 illustrates an example scheme by which a touch pad controller provides user inputs to individually control the retractable guide pins of FIG. 7;

DISCLOSURE OF INVENTION

Example embodiments of the present invention involve skill games and, in particular, pusher game apparatuses (e.g., coin pusher game apparatuses) that include one or more player-repositionable game piece guide members configured such that the game is predominantly one of skill, rather than luck or chance, or at least in part dependent upon the skill of the player.

Figure 1:
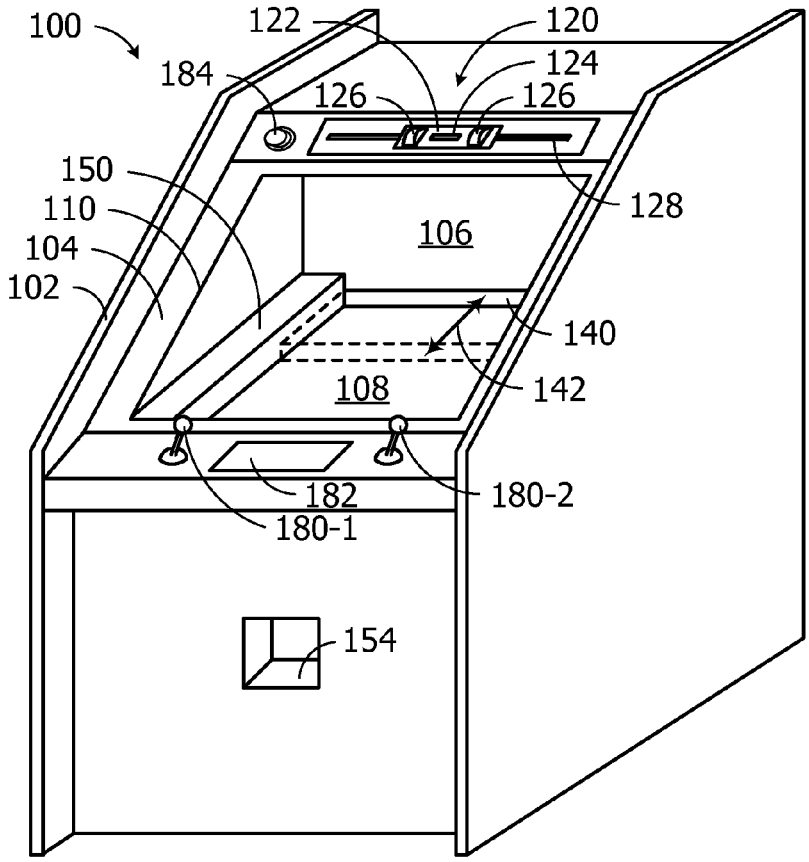
FIG. 1 is a perspective view of an example embodiment of a skill game apparatus.

Referring to FIG. 1, in an example embodiment, a skill game apparatus 100 includes an enclosure 102 with a front portion 104 through which a player can see inside the enclosure 102, and a back portion 106 and a base portion 108 that provide a game piece path within the enclosure 102. The front portion 104 serves as a frame for a window 110 (e.g., a piece of plastic or other material that is transparent or sufficiently transparent for a player to see inside the enclosure 102).

The skill game apparatus 100 includes a game piece introducing device 120 configured to allow a player to direct a game piece toward the back portion 106 of the enclosure 102. The game piece introducing device 120 is configured to allow the player to direct a game piece toward the back portion 106 in a manner that is dependent at least in part upon the skill of the player (e.g., in operating the game piece introducing device 120). In this example embodiment, the game piece introducing device 120 includes a slider element 122 with an aperture 124 sized to receive a game piece and one or more handles 126 which the player can grasp or otherwise engage to reposition the game piece introducing device 120 along a track 128. The slider element 122 is coupled to and repositionable by the player in relation to the enclosure 102. In this example embodiment, the aperture 124 is sized (and shaped) to receive a game piece such as a coin, token, or the like. In example embodiments, the game piece introducing device 120 is configured to allow the player to introduce a game piece that is coin-shaped. It should be understood that the principles of the present invention are also applicable to game pieces other than coins, tokens, or the like, and the aperture 124 can vary in size and/or shape depending upon the game pieces intended for use with a particular skill game apparatus.

Figure 3:
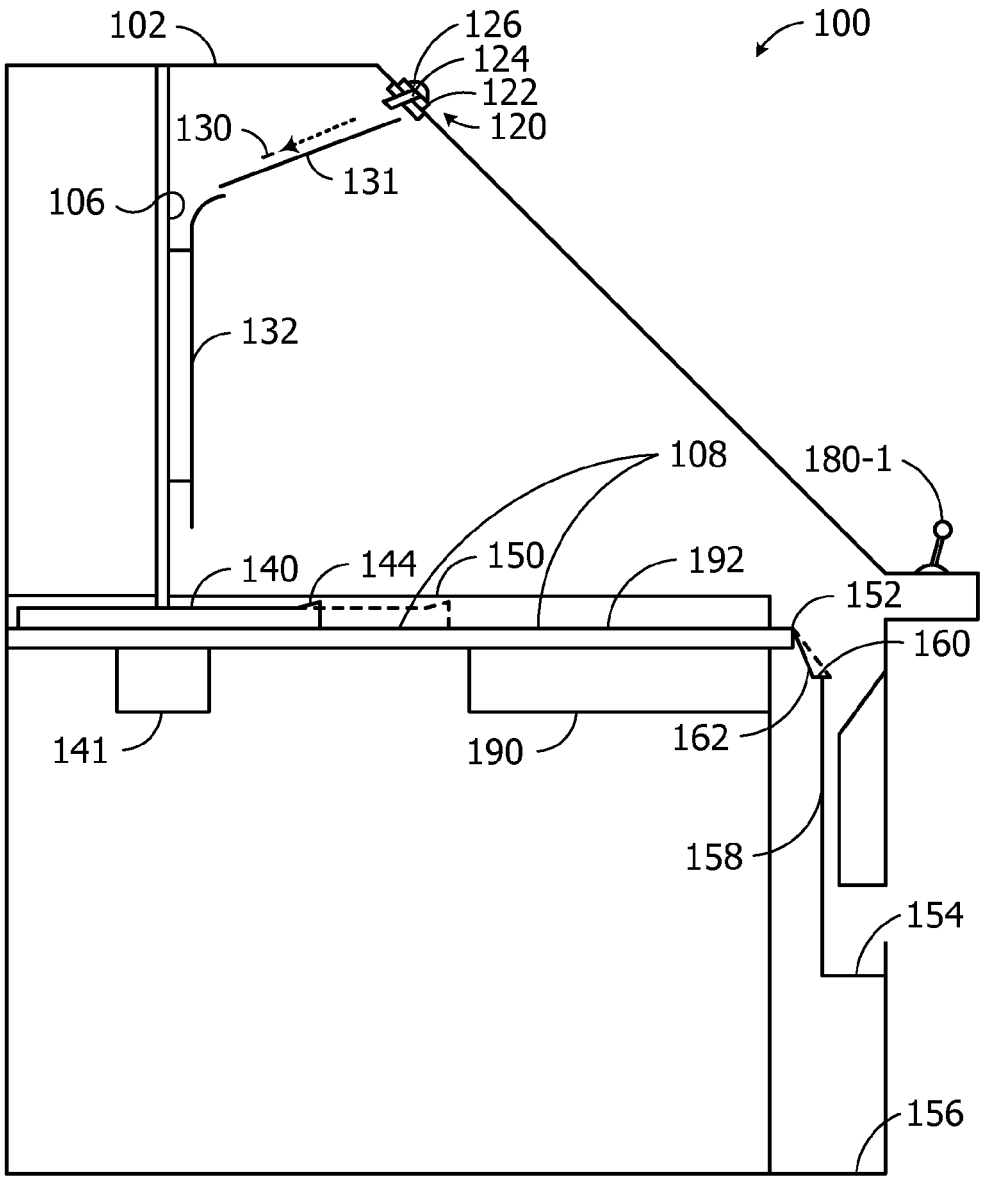
FIG. 3 is a cross-sectional side view of the example embodiment of a skill game apparatus of FIG. 1.

Referring also to FIG. 3, a game piece 130 (which has been introduced into the enclosure 102 through the aperture 124) is shown as it moves over a ramp 131 toward the back portion 106 of the enclosure 102. The ramp 131 spans from below the aperture 124 toward the back portion 106 as shown. The ramp 131 is sufficiently inclined or otherwise configured to advance, e.g., in conjunction with gravity, the game piece 130 down the inclined surface bringing the game piece 130 into contact with the back portion 106. Thus, as configured in this illustrated example, the game piece introducing device 120 serves as a mechanism for directing a game piece or attempting to direct a game piece depending upon the player's level of skill toward a player selected location at the top of the back portion 106. To this end, the game piece introducing device 120 is configured to allow the player to introduce a game piece into the enclosure 102 at a player selectable point of entry along the track 128. Other mechanisms for selectively directing a game piece toward a location within the enclosure 102 can also be utilized. In this illustrated example, the skill game apparatus 100 includes a wall 132 (FIG. 3) which together with the back portion 106 defines a portion of the game piece path spanning from the top of the wall 132 to the bottom of the back portion 106. In an example embodiment, the wall 132 is made from a piece of plastic or other material that is (sufficiently) transparent to allow a player to observe coins or other game pieces as they move downward along the portion of the game piece path adjacent to the back portion 106.

Referring again to FIGS. 1 and 3, in this example embodiment, the skill game apparatus 100 includes a pusher device 140 configured to move over the base portion 108 as depicted by arrow 142 (FIG. 1) such that the pusher device 140 contacts game pieces that have landed on the base portion 108. The pusher device 140 can be a conventional motorized apparatus configured, for example, to automatically move over the base portion 108 (e.g., in a reciprocating motion) driven by a motor 141 (e.g., when a game is being played). In this illustrated example, coins (or other game pieces) that land on the top of the pusher device 140 and come to rest sufficiently close to the back portion 106 are pushed toward a front edge of the pusher device 140 as the pusher device 140 moves toward its fully retracted position. The top of the pusher device 140 moves adjacent to a bottom edge of the back portion 106, with the spacing therebetween being sufficiently close to prevent coins or other game pieces of an expected size from being pulled beneath the bottom edge of the back portion 106.

The pusher device 140 can, but does not necessarily, include an edge 144 (FIG. 3) which can be varied in height, e.g., relative to adjacent portions of the pusher device 140. Depending upon the shape of the edge 144, a greater or lesser number of coins will accumulate on the top of the pusher device 140 before coins near the edge 144 are pushed over the edge 144 (which can happen, for example, as a consequence of chain reaction of the back portion 106 coming into contact with a group of coins positioned on the top of the pusher device 140). Alternatively, the edge 144 is not elevated but, rather, is the same height (or thickness) as adjacent portions of the pusher device 140. In this illustrated example, sidewalls 150 are provided on either side of the base portion 108 as shown. In an example embodiment, coins or other game pieces that land on the sidewalls 150 are outside the game piece path.

The base portion 108 includes a front edge 152 (FIG. 3) from which a game piece, upon being advanced sufficiently far along the game piece path, drops into a game piece receptacle. In this example embodiment, the skill game apparatus 100 is provided with a player payout receptacle 154 and a house receptacle 156 which are separated by a wall 158 as shown. The wall 158 can also be provided with a top portion 160 that is sufficiently wide for coins falling over the front edge 152 to land upon, thusly, potentially motivating a player to seek to direct coins over a particular portion of the front edge 152 for the purpose of attempting to dislodge coins resting upon the top portion 160 and causing such target coins to fall into the player payout receptacle 154. The top portion 160 can be flat, concave, convex, or shaped in other ways still. The skill game apparatus 100 can also be provided with a detachable barrier 162 that can be used to block all coins or other game pieces from falling into the house receptacle 156. In an example embodiment, the detachable barrier 162 can be attached at either the front (as shown by the dashed line) or back edge of the top portion 160 to cover or expose the top portion 160 as desired.

In example embodiments, one or more of the back portion 106 and the base portion 108 are provided with one or more game piece guiding elements configured to influence movement of game pieces within a game piece path in a manner that is dependent at least in part upon the skill of the player. In an example embodiment, only the back portion 106 is provided with one or more game piece guiding elements configured to influence movement of game pieces within a game piece path in a manner that is dependent at least in part upon the skill of the player. In an example embodiment, only the base portion 108 is provided with one or more game piece guiding elements configured to influence movement of game pieces within a game piece path in a manner that is dependent at least in part upon the skill of the player.

In an example embodiment, the back portion 106 includes one or more guide channels configured to limit horizontal movement by a game piece as it moves from the top of the back portion to the base portion. For example, the one or more guide channels include substantially parallel surfaces that define at least a portion of the one or more guide channels.

Figure 2:
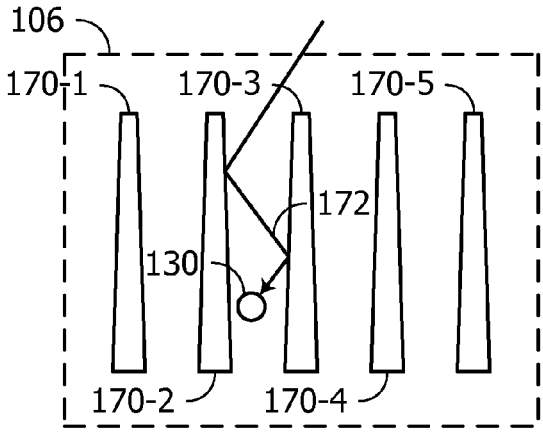
FIG. 2 illustrates an example arrangement of game piece guide channels.

Referring to FIG. 2, the back portion 106 (example boundaries of which are represented by dashed lines) is configured with rail members 170-1, 170-2, 170-3, 170-4 and 170-5. The rail members 170-1, 170-2, 170-3, 170-4 and 170-5 define guide channels which limit horizontal movement (left to right movement with reference to FIG. 2) by a coin or other game piece as it moves from the top of the back portion 106 toward the base portion 108. In this example, a game piece 130 is shown moving along a path (denoted by arrow 172) through a channel defined on opposite sides by the rail members 170-2 and 170-3. In this illustrated example, the rail members 170-1, 170-2, 170-3, 170-4 and 170-5 are wedge-shaped. The number, shape, spacing and/or arrangement of the rail members or other elements that define the guide channels can vary.

In this illustrated example, the rail members 170-1, 170-2, 170-3, 170-4 and 170-5 are fixed in position in relation to the back portion 106. Alternatively, as discussed below, one or more game piece guiding elements are repositionable by a player of the skill game apparatus 100. In either case, game piece guiding members located on the back portion 106 challenge the skill of the player at least with respect to the motor control, dexterity, etc. required to properly introduce a game piece into and manipulate the game piece introducing device 120 to the end of implementing a game piece placement strategy involving placement of the game piece within a particular guide channel.

In example embodiments, one or more of the back portion 106 and the base portion 108 are provided with one or more game piece guiding elements that are repositionable by a player of the skill game apparatus 100. In an example embodiment, only the back portion 106 is provided with one or more game piece guiding elements that are repositionable by a player of the skill game apparatus 100. In an example embodiment, only the base portion 108 is provided with one or more game piece guiding elements that are repositionable by a player of the skill game apparatus 100.

In example embodiments, the skill game apparatus 100 includes one or more player-repositionable game piece guide members that are moveable in relation to the game piece path in response to inputs provided by one or more player controller devices. The one or more player controller devices include one or more player input mechanisms. By way of example, and referring to FIGS. 1 and 3, the one or more player controller devices include joysticks 180-1 and 180-2, a touchpad 182, and a button 184 (e.g., a "Start" button). In an example embodiment, the player input mechanisms include one or more joysticks or a touchpad (and/or other devices that facilitate providing a player input).

Referring to FIG. 3, in this example embodiment, the skill game apparatus 100 includes an actuator device 190 which is configured and controlled as described herein to actuate and retract one or more player-repositionable game piece guide members in relation to a front portion 192 of the base portion 108. In an example embodiment, the front portion 192 is an area located above the actuator device 190, between the front edge 152 of the base portion 108 and the edge 144 of the pusher device 140 at its most extended position. The front portion 192 includes apertures, openings, bores or the like configured to receive player-repositionable game piece guide members and to permit movement (e.g., vertical movement, rotational movement) of the guide members therein in response to forces, mechanical engagements or the like effected by the actuator device 190.

Figure 4:
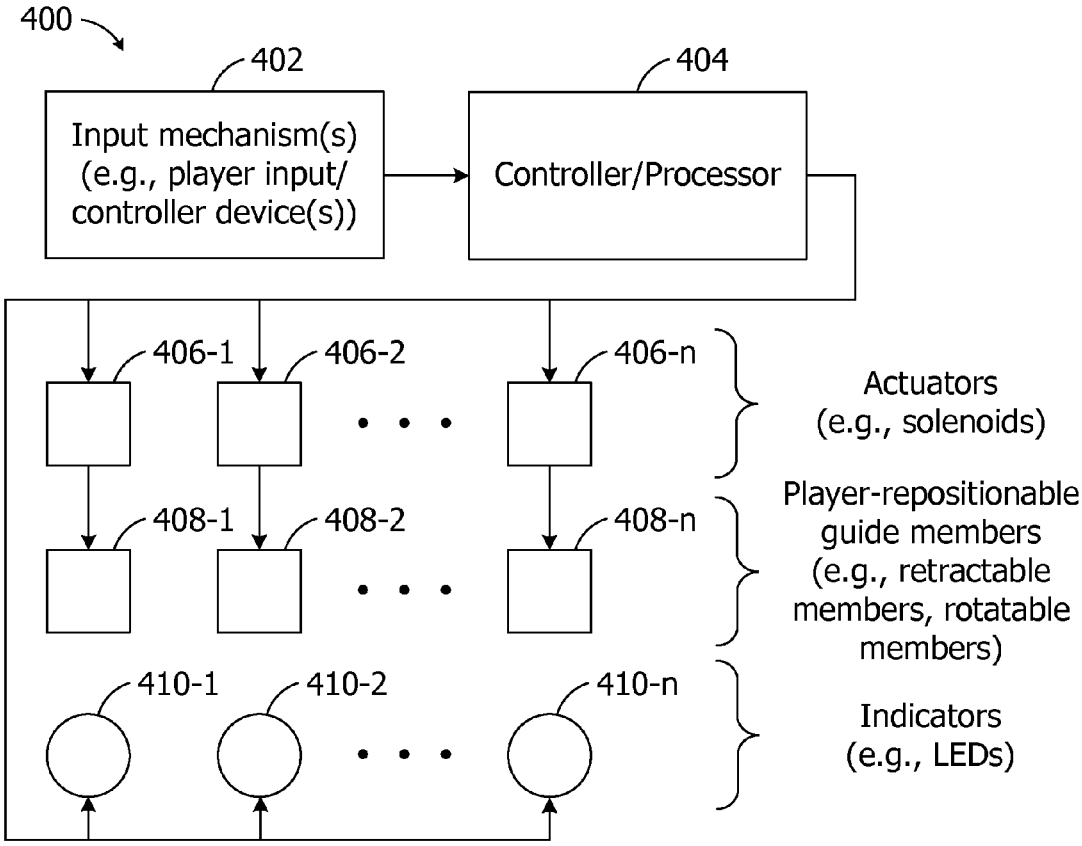
FIG. 4 is a diagram of an example system for controlling one or more player-repositionable guide members.

Referring to FIG. 4, an example system 400 for controlling one or more player-repositionable guide members includes one or more input mechanisms 402 (e.g., player input/controller device(s)) configured to provide player inputs to a controller (or processor) 404. In an example embodiment, the controller 404 is additionally programmed to control the motor 141 that drives the pusher device 140, e.g., in response to an input generated when the button 184 is pushed or otherwise actuated. The controller 404 can also be provided with inputs that are not generated by a player. For example, commands, detected conditions, or the like can be provided to the controller 404 as additional inputs, which the controller 404 processes or utilizes in a variety of different ways including, but not limited to, supplementing and/or modifying player inputs, and interrupting or overriding one or more functions performed by the skill game apparatus 100.

The controller 404 is programmed to process the player inputs (and non-player inputs, if any) to provide control signals to one or more actuators, in this example, denoted as actuators 406-1, 406-2, . . . **406-*n*, where $n \geqq 1$. Each of the actuators 406-1, 406-2, . . . 406-*n* include, for example, a solenoid or other device capable of imparting a force directed toward one or more player-repositionable guide members (e.g., retractable guide members, rotatable guide members), in this example, denoted as player-repositionable guide members 408-1, 408-2, . . . 408-*n*, respectively. In this example system, the controller 404 is also programmed to provide control signals to one or more indicators, in this example, denoted as indicators 410-1, 410-2, . . . 410-*n*, where $n \geqq 1$. For example, the indicators 410-1, 410-2, . . . 410-*n*** can be one or more lights (e.g., LEDs) configured to indicate which, if any, of the one or more player-repositionable game piece guide members are activated.

Figure 5:
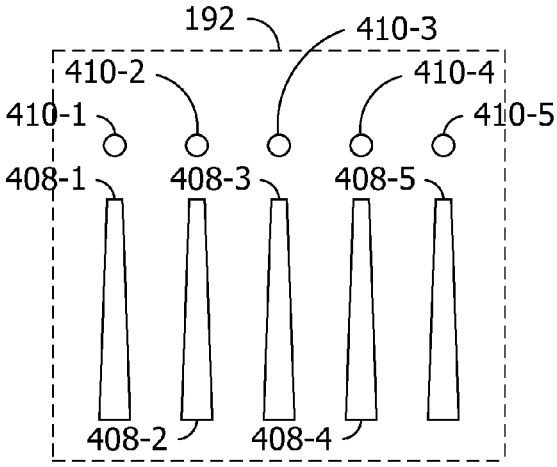
FIG. 5 illustrates an example arrangement of retractable guide members and actuation indicators.

Referring to FIG. 5, an example arrangement of retractable guide members and actuation indicators is illustrated. In this example, the retractable guide members 408-1, 408-2, 408-3, 408-4, and 408-5 are wedge-shaped and define, in various combinations, guide channels therebetween. In an example embodiment, the one or more player-repositionable game piece guide members include one or more wedge-shaped members. The number, shape, spacing and/or arrangement of the retractable guide members can vary. In this example, the guide members 408-1, 408-2, 408-3, 408-4, and 408-5 are provided with actuation indicators 410-1, 410-2, 410-3, 410-4, and 410-5, respectively, such as LEDs and/or other devices capable of producing visible indicia detectable by a player.

In this example embodiment, the one or more player-repositionable game piece guide members 408-1, 408-2, . . . **408-*n* are located on the base portion 108 (e.g., between the pusher device 140 and the front edge 152 of the base portion 108). Referring again to FIG. 5, in this example, the front portion 192 (example boundaries of which are represented by dashed lines) of the base portion 108 is configured with five player-repositionable game piece guide members, which are controlled by the player to provide guide channels along a portion of the game piece path located between the pusher device 140 and the front edge 152 of the base portion 108**. In an example embodiment, the one or more player-repositionable game piece guide members include one or more retractable members which extend from the base portion when activated by an input provided by the one or more player controller devices.

The player-repositionable game piece guide members can be controlled (e.g., actuated and retracted, rotated) in various ways. Example schemes by which input mechanisms can be utilized to provide user inputs to control the one or more retractable members are described below.

Figure 6:
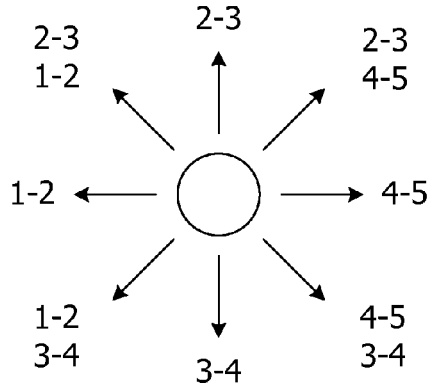
FIG. 6 illustrates an example scheme by which a joystick controller provides user inputs to control the retractable guide members of FIG. 5.

FIG. 6 illustrates an example scheme by which a joystick controller provides player inputs to control movement of the retractable guide members of FIG. 5. In this example scheme, pairs selected from a group of guide members that includes the retractable guide members 408-1, 408-2, 408-3, 408-4, 408-5 are actuated (e.g., extended) depending upon the position of the joystick controller. When the joystick is in its center position, none of the guide members are actuated. For purposes of this description, up, down, right, and left joystick positions will be referred to as N, S, E, and W positions, respectively. In this example scheme, in the N position, the pair of guide members 408-2, 408-3 is actuated. In the S position, the pair of guide members 408-3, 408-4 is actuated. In the E position, the pair of guide members 408-4, 408-5 is actuated. In the W position, the pair of guide members 408-1, 408-2 is actuated. In this example scheme, the NE, SE, NW, and SW positions are where the player input (generated by the joystick controller) changes as the joystick controller moves clockwise transitioning between joystick regions associated with the N, E, W, and W positions, respectively. In an example embodiment, the one or more player-repositionable game piece guide members include multiple retractable members, and the one or more player controller devices are configured to allow the player to selectively activate pairs of the retractable members.

Figure 7:
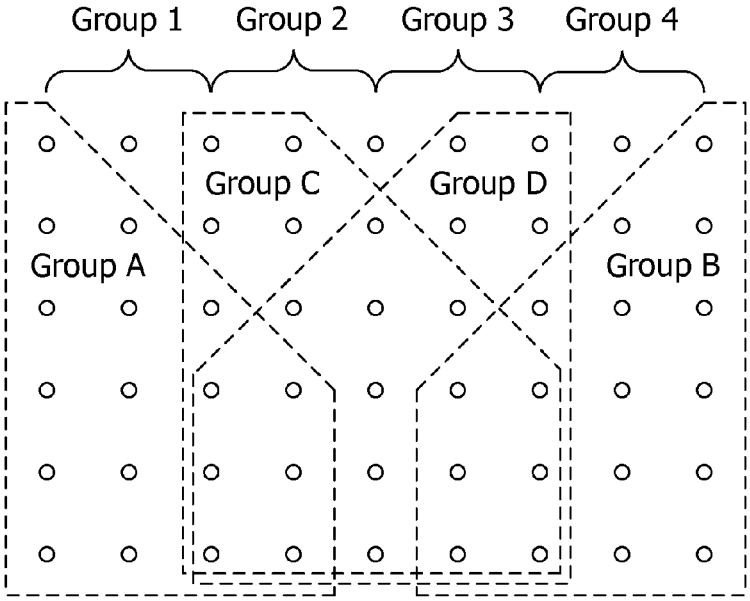
FIG. 7 illustrates an example arrangement of retractable guide pins and example groupings thereof.

Referring to FIG. 7, an example arrangement of retractable guide pins and example groupings thereof are illustrated. In this example, the retractable guide pins are provided in a 9×6 array arrangement (located, for example, within the front portion 192 of the base portion 108) and define, in various combinations, groups of guide pins that can be actuated to guide game pieces in different ways. In an example embodiment, the one or more player-repositionable game piece guide members include one or more pin-shaped members. The number, shape, spacing and/or arrangement of the retractable guide pins can vary, as can the members included in particular groupings of the guide pins.

In this example, the guide pin grouping referred to as "Group 1" includes the first three columns of pins. The guide pin groupings referred to as "Group 2", "Group 3", and "Group 4" also each include three columns of pins as denoted. In this example, Groups 1-4 are column-shaped groups of pins that each include members that define a vertical line of pins (e.g., a line along or parallel with the game piece path or a portion thereof). In an example embodiment, at least one of the groups includes an arrangement of retractable members which when activated guide game pieces along the game piece path.

In this example, each of the guide pin groupings referred to as "Group A", "Group B", "Group C", and "Group D" includes members that define a diagonal line of pins. In an example embodiment, at least one of the groups includes an arrangement of retractable members which when activated guide game pieces diagonally or laterally in relation to the game piece path.

FIG. 8 illustrates an example scheme by which a joystick controller provides player inputs to control a group (among Groups 1-4) of the retractable guide pins of FIG. 7. In this example scheme, a group of the guide pins is actuated (e.g., extended) depending upon the position of the joystick controller. When the joystick is in its center position, none of the groups is actuated. For purposes of this description, up, down, right, and left joystick positions will be referred to as N, S, E, and W positions, respectively. In this example scheme, in the N position, the guide pins in Group 2 are actuated. In the S position, the guide pins in Group 3 are actuated. In the E position, the guide pins in Group 4 are actuated. In the W position, the guide pins in Group 1 are actuated. In this example, the NE, SE, NW, and SW positions are where the player input (generated by the joystick controller) changes as the joystick controller moves clockwise transitioning between joystick regions associated with the N, E, W, and W positions, respectively.

Alternatively, the NE, SE, NW, and SW positions can be utilized to allow the player to selectively activate multiple groups of the retractable pins. Referring to FIG. 8, by way of example, an additional user input mechanism can be simultaneously triggered by the player when the joystick is in its NE, SE, NW, and SW positions to selectively activate multiple groups of the retractable pins. For example, in the NE position, when the controller receives an input generated by the aforementioned player-initiated triggering event, the guide pins in Groups 2-4 (or, alternatively, in Groups 2 and 4) are actuated.

FIG. 9 illustrates an example scheme by which a joystick controller provides player inputs to control a group (among Groups A-D) of the retractable guide pins of FIG. 7. In this example scheme, a group of the guide pins is actuated (e.g., extended) depending upon the position of the joystick controller. When the joystick is in its center position, none of the groups is actuated. For purposes of this description, up, down, right, and left joystick positions will be referred to as N, S, E, and W positions, respectively. In this example scheme, in the N position, the guide pins in Group A are actuated. In the S position, the guide pins in Group D are actuated. In the E position, the guide pins in Group B are actuated. In the W position, the guide pins in Group C are actuated. In this example, the NE, SE, NW, and SW positions are where the player input (generated by the joystick controller) changes as the joystick controller moves clockwise transitioning between joystick regions associated with the N, E, W, and W positions, respectively.

Alternatively, the NE, SE, NW, and SW positions can be utilized to allow the player to selectively activate multiple groups of the retractable pins. Referring to FIG. 9, by way of example, an additional user input mechanism can be simultaneously triggered by the player when the joystick is in its NE, SE, NW, and SW positions to selectively activate multiple groups of the retractable pins. For example, in the NE position, when the controller receives an input generated by the aforementioned player-initiated triggering event, the guide pins in Groups A-B are actuated.

In the example control schemes of FIGS. 8 and 9, some of the retractable pins are members of more than one of the groups. In an example embodiment, the player controller devices are configured to prevent the player from simultaneously activating groups with shared members. In another example embodiment, the player controller devices are configured to allow the player to simultaneously activate groups with shared members.

In an example embodiment, the one or more player-repositionable game piece guide members include multiple retractable members, and the one or more player controller devices are configured to allow the player to selectively activate one or more groups of the retractable members. In an example embodiment, the player controller devices are configured to allow the player to selectively activate one or more pairs of the groups.

FIG. 10 illustrates an example scheme by which a touch pad controller provides user inputs to individually control the retractable guide pins of FIG. 7. In this example scheme, guide pins can be individually raised (e.g., utilizing a user input mechanism such as a touch pad) to form a pathway or guide for coins or other game pieces. In this example, the touch pad 182 (FIG. 10) is configured to allow the player to individually select pins that are to be actuated from the 9×6 array of pins (FIG. 7). In an example embodiment, the one or more player-repositionable game piece guide members include multiple retractable members, and the one or more player controller devices are configured to allow the player to selectively individually activate one or more of the retractable members.

Figure 11:
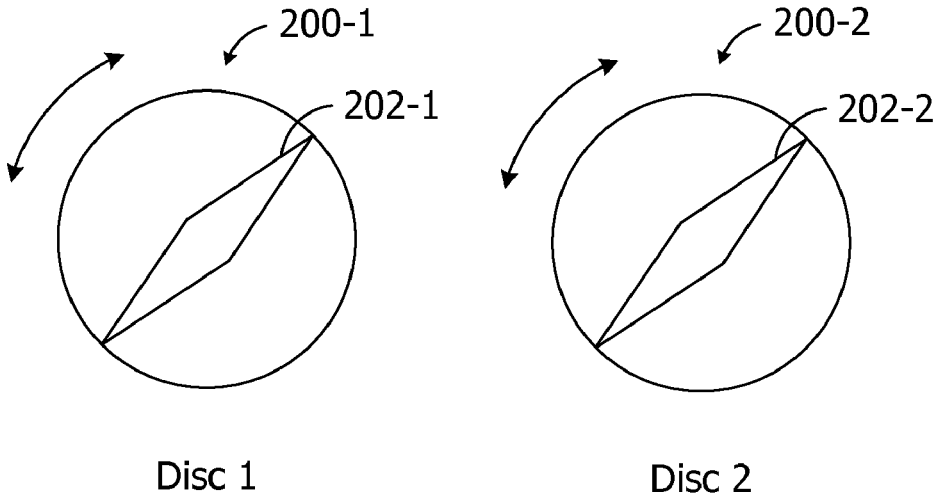
FIG. 11 illustrates an example arrangement of rotatable guide members.

Referring to FIG. 11, an example arrangement of rotatable guide members is illustrated. In this example, the rotatable guide members are provided by a pair of rotatable disc members 200-1 and 200-2 (located, for example, within the front portion 192 of the base portion 108). In this example, the actuator device 190 is configured to rotate the disc members 200-1 and 200-2 in relation to the game piece path. In this example, the disc members 200-1 and 200-2 include fin-shaped members 202-1 and 202-2, respectively. In an example embodiment, the fin-shaped members 202-1 and 202-2 extend upward from the game piece path, while adjacent upward-facing portions of the disc members 200-1 and 200-2 are substantially flush with (i.e., at the same height as) the surrounding portions of the game piece path. In an example embodiment, the one or more player-repositionable game piece guide members include one or more fin-shaped members. In an example embodiment, the one or more rotatable members include one or more guide members that extend from the base portion. The number, shape, spacing and/or arrangement of the rotatable guide members can vary.

In an example embodiment, the one or more player-repositionable game piece guide members include one or more rotatable members which rotate in relation to the base portion when activated by an input provided by the one or more player controller devices. For example, rotational movement of the disc members 200-1 and 200-2 is selectively activated, and the direction of movement (either clockwise or counterclockwise) controlled depending upon the position of a user input device such as a joystick. Movement of the disc members 200-1 and 200-2 (e.g., within the base portion 108) results in corresponding movement of the raised fin-shaped members 202-1 and 202-2, respectively, allowing the player to guide the coins or other game pieces.

Figure 12:
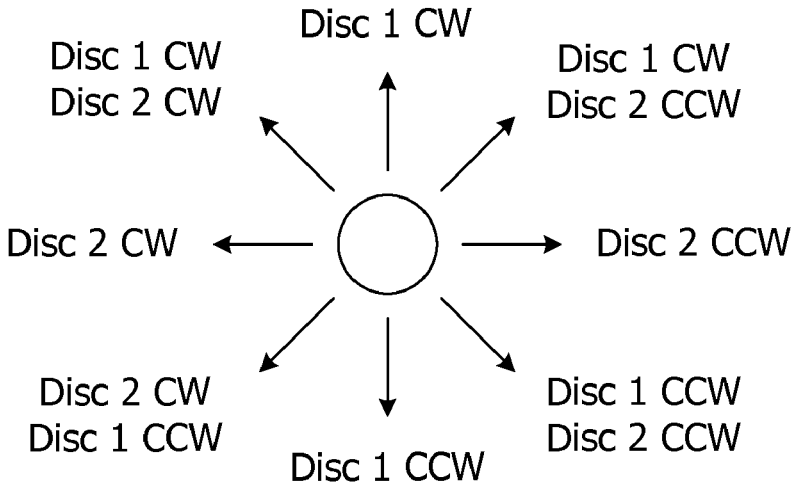
FIG. 12 illustrates an example scheme by which a joystick controller provides user inputs to control the rotatable guide members of FIG. 11.

FIG. 12 illustrates an example scheme by which a joystick controller provides player inputs to control the rotatable guide members of FIG. 11. In this example scheme, rotational movement of the disc members 200-1 and 200-2 is selectively activated, and the direction of movement (either clockwise or counterclockwise) controlled depending upon the position of a player input device such as a joystick. When the joystick is in its center position, neither of the disc members 200-1 and 200-2 ("Disc 1" and "Disc 2", respectively) is driven to rotate. For purposes of this description, up, down, right, and left joystick positions will be referred to as N, S, E, and W positions, respectively. In this example scheme, in the N position, Disc 1 is rotated clockwise (CW). In the S position, Disc 1 is rotated counterclockwise (CCW). In the E position, Disc 2 is rotated counterclockwise (CCW). In the W position, Disc 2 is rotated clockwise (CW).

In this example scheme, the NE, SE, NW, and SW positions are joystick locations where the player input (generated by the joystick controller) allows the player to control simultaneous movement of both of the disc members 200-1 and 200-2. For example, in the NE position, Disc 1 is rotated clockwise (CW) and Disc 2 is rotated counterclockwise (CCW). In the SE position, Disc 1 is rotated counterclockwise (CCW) and Disc 2 is rotated counterclockwise (CCW). In the SW position, Disc 2 is rotated clockwise (CW) and Disc 1 is rotated counterclockwise (CCW). In the NW position, Disc 1 is rotated clockwise (CW) and Disc 2 is rotated clockwise (CW).

In an example embodiment, the one or more rotatable members include multiple rotatable members, and the one or more player controller devices are configured to allow the player to selectively activate one or more of the rotatable members. In an example embodiment, the one or more rotatable members include a multiple rotatable members, and the one or more player controller devices are configured to allow the player to selectively control a direction of rotation for one or more of the rotatable members.

As described herein in example embodiments, the one or more player-repositionable game piece guide members are moveable in a manner that is dependent at least in part upon the skill of the player in operating the one or more player controller devices. For example, game piece guiding members located on the base portion 108 challenge the skill of the player at least with respect to the motor control, dexterity, etc. required to properly control the one or more player-repositionable game piece guide members to the end of implementing a game piece guiding strategy.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A skill game apparatus comprising:

an enclosure including a front portion through which a player can see inside the enclosure, and a back portion and a base portion that provide a game piece path within the enclosure;

a game piece introducing device configured to allow a player to direct a game piece toward the back portion;

a pusher device configured to move over the base portion such that the pusher device contacts game pieces that have landed on the base portion; and one or more player-repositionable game piece guide members that are moveable in relation to the game piece path in response to inputs provided by one or more player controller devices;

wherein the base portion includes a front edge from which a game piece, upon being advanced sufficiently far along the game piece path, drops into a game piece receptacle.

2. The skill game apparatus of claim 1, wherein the back portion includes one or more guide channels configured to limit horizontal movement by a game piece as it moves from the top of the back portion to the base portion.

3. The skill game apparatus of claim 2, wherein the one or more guide channels include a plurality of rail members.

4. The skill game apparatus of claim 2, wherein the one or more guide channels include substantially parallel surfaces that define at least a portion of the one or more guide channels.

5. The skill game apparatus of claim 1, wherein the game piece introducing device is configured to allow the player to direct a game piece toward the back portion in a manner that is dependent at least in part upon the skill of the player in operating the game piece introducing device.

6. The skill game apparatus of claim 1, wherein the game piece introducing device is configured to allow the player to introduce a game piece into the enclosure at a player selectable point of entry.

7. The skill game apparatus of claim 1, wherein the game piece introducing device includes a slider element with an aperture sized to receive the game piece, the slider element being coupled to and repositionable by the player in relation to the enclosure.

8. The skill game apparatus of claim 1, wherein the game piece introducing device is configured to allow the player to introduce a game piece that is coin-shaped.

9. The skill game apparatus of claim 1, wherein the pusher device is configured to automatically move over the base portion when a game is being played.

10. The skill game apparatus of claim 1, wherein the pusher device is configured to automatically move over the base in a reciprocating motion.

11. The skill game apparatus of claim 1, wherein the one or more player-repositionable game piece guide members are moveable in a manner that is dependent at least in part upon the skill of the player in operating the one or more player controller devices.

12. The skill game apparatus of claim 1, wherein the one or more player-repositionable game piece guide members are located on the base portion.

13. The skill game apparatus of claim 1, wherein the one or more player-repositionable game piece guide members are located between the pusher device and the front edge of the base portion.

14. The skill game apparatus of claim 1, further comprising:

one or more player controller devices configured to provide the inputs, the one or more player controller devices including one or more player input mechanisms.

15. The skill game apparatus of claim 14, wherein the player input mechanisms include one or more joysticks or a touchpad.

16. The skill game apparatus of claim 1, wherein the one or more player-repositionable game piece guide members include one or more wedge-shaped members.

17. The skill game apparatus of claim 1, wherein the one or more player-repositionable game piece guide members include one or more pin-shaped members.

18. The skill game apparatus of claim 1, wherein the one or more player-repositionable game piece guide members include one or more fin-shaped members.

19. The skill game apparatus of claim 1, wherein the one or more player-repositionable game piece guide members include one or more retractable members which extend from the base portion when activated by an input provided by the one or more player controller devices.

20. The skill game apparatus of claim 19, wherein the one or more player-repositionable game piece guide members include a plurality of retractable members, and the one or more player controller devices are configured to allow the player to selectively activate pairs of the retractable members.

21. The skill game apparatus of claim 19, wherein the one or more player-repositionable game piece guide members include a plurality of retractable members, and the one or more player controller devices are configured to allow the player to selectively activate one or more groups of the retractable members.

22. The skill game apparatus of claim 21, wherein at least one of the groups includes an arrangement of retractable members which when activated guide game pieces along the game piece path.

23. The skill game apparatus of claim 21, wherein at least one of the groups includes an arrangement of retractable members which when activated guide game pieces diagonally or laterally in relation to the game piece path.

24. The skill game apparatus of claim 21, wherein the player controller devices are configured to allow the player to selectively activate one or more pairs of the groups.

25. The skill game apparatus of claim 21, wherein some of the retractable members are members of more than one of the groups.

26. The skill game apparatus of claim 25, wherein the player controller devices are configured to prevent the player from simultaneously activating groups with shared members.

27. The skill game apparatus of claim 25, wherein the player controller devices are configured to allow the player to simultaneously activate groups with shared members.

28. The skill game apparatus of claim 19, wherein the one or more player-repositionable game piece guide members include a plurality of retractable members, and the one or more player controller devices are configured to allow the player to selectively individually activate one or more of the retractable members.

29. The skill game apparatus of claim 1, wherein the one or more player-repositionable game piece guide members include one or more rotatable members which rotate in relation to the base portion when activated by an input provided by the one or more player controller devices.

30. The skill game apparatus of claim 29, wherein the one or more rotatable members include one or more guide members that extend from the base portion.

31. The skill game apparatus of claim 30, wherein the one or more rotatable members include a plurality of rotatable members, and the one or more player controller devices are configured to allow the player to selectively activate one or more of the rotatable members.

32. The skill game apparatus of claim 30, wherein the one or more rotatable members include a plurality of rotatable members, and the one or more player controller devices are configured to allow the player to selectively control a direction of rotation for one or more of the rotatable members.

33. The skill game apparatus of claim 29, further comprising:

one or more lights configured to indicate which of the one or more player-repositionable game piece guide members are activated.

34. A skill game apparatus comprising:

an enclosure including a front portion through which a player can see inside the enclosure, and a back portion and a base portion that provide a game piece path within the enclosure;

a game piece introducing device configured to allow a player to direct a game piece toward the back portion; and a pusher device configured to move over the base portion such that the pusher device contacts game pieces that have landed on the base portion; and wherein the back portion includes one or more guide channels configured to limit horizontal movement by a game piece as it moves from the top of the back portion to the base portion;

wherein the base portion includes a front edge from which a game piece, upon being advanced sufficiently far along the game piece path, drops into a game piece receptacle.

35. The skill game apparatus of claim 34, wherein the one or more guide channels include a plurality of rail members.

36. The skill game apparatus of claim 34, wherein the one or more guide channels include substantially parallel surfaces that define at least a portion of the one or more guide channels.

37. The skill game apparatus of claim 34, wherein the game piece introducing device is configured to allow the player to direct a game piece toward the back portion in a manner that is dependent at least in part upon the skill of the player in operating the game piece introducing device.

38. The skill game apparatus of claim 34, wherein the game piece introducing device is configured to allow the player to introduce a game piece into the enclosure at a player selectable point of entry.

39. The skill game apparatus of claim 34, wherein the game piece introducing device includes a slider element with an aperture sized to receive the game piece, the slider element being coupled to and repositionable by the player in relation to the enclosure.

40. The skill game apparatus of claim 34, wherein the game piece introducing device is configured to allow the player to introduce a game piece that is coin-shaped.

* * * * *